US011241067B2

(12) United States Patent
Ben-Arie

(10) Patent No.: US 11,241,067 B2
(45) **Date of Patent: *Feb. 8, 2022**

(54) HIDDEN BLADE BELT RATCHETING DEVICE IV

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/134,247

(22) Filed: Dec. 25, 2020

(65) Prior Publication Data

US 2021/0251347 A1 Aug. 19, 2021

Related U.S. Application Data

(63) Continuation-in-part of application No. 16/792,324, filed on Feb. 17, 2020, now Pat. No. 10,874,177.

(51) Int. Cl.
*A44B 11/12* (2006.01)
*A44B 11/16* (2006.01)

(52) U.S. Cl.
CPC ..... *A44B 11/12* (2013.01); *A44B 11/16* (2013.01)

(58) Field of Classification Search
CPC ..... A44B 11/12; A44B 11/16; A44B 11/125
See application file for complete search history.

(56) References Cited

U.S. PATENT DOCUMENTS 1,506,349 A * 8/1924 Kerngood ..... A44B 11/12 24/191
2,888,729 A * 6/1959 Lethern ..... A44B 11/12 24/587.12
4,071,964 A 2/1978 Vogiatzis
4,125,918 A 11/1978 Baumann
4,130,949 A 12/1978 Seidel
4,261,081 A 4/1981 Lott
4,420,858 A * 12/1983 Noda ..... A44B 11/12 24/170
4,458,373 A 7/1984 Maslow
4,507,878 A 4/1985 Semouha
4,616,432 A 10/1986 Bunch
4,648,159 A 3/1987 Dougherty
4,991,273 A 2/1991 Huttle
5,001,847 A 3/1991 Waters
5,097,573 A 3/1992 Gimeno
(Continued)

FOREIGN PATENT DOCUMENTS

DE 3344489 A1 12/1983

*Primary Examiner* — David M Upchurch

(57) ABSTRACT

The Hidden Blade Belt Ratcheting Device (HB-BRD) facilitates unidirectional belt fastening and fast release. The HB-BRD includes a turning gate rotatably installed diagonally in a channel. The turning gate has a hidden sharp blade front which operates below on the lower belt surface avoiding visible scratches. Attached at the rear is a resilient plate which acts as a spring. The HB-BRD has two states: "active" and "inactive". In the active state the device works as a belt ratchet i.e. allowing the belt to be pulled forwards but restricting any belt motion backwards. In the inactive state the ratcheting is disabled and the belt is released. Usually, the BRD is kept in active state by a preloaded resilient plate. After fastening, the belt remains fastened until the HB-BRD is switched manually into inactive state by pulling a latch. The blade's smooth side and channel's smooth surfaces minimize belt wear.

11 Claims, 7 Drawing Sheets

(56) References Cited

U.S. PATENT DOCUMENTS 5,109,581 A 5/1992 Gould
5,119,539 A 6/1992 Curry
5,177,882 A 1/1993 Berger
5,203,053 A 4/1993 Rudd
5,230,171 A 7/1993 Cardaropoli
5,293,669 A 3/1994 Sampson
5,293,675 A 3/1994 Shai
5,295,315 A 3/1994 Osawa
5,335,401 A 8/1994 Hanson
5,467,511 A 11/1995 Kubo
5,477,593 A 12/1995 Leick
5,572,774 A 11/1996 Duran
5,572,777 A 11/1996 Shelton
5,588,186 A 12/1996 Ko
5,647,824 A 7/1997 Levenson
5,661,877 A * 9/1997 Bloomer ..... A44B 11/12 24/170
6,076,241 A 6/2000 Borel
6,094,787 A 8/2000 Chang
6,192,241 B1 2/2001 Yu
6,192,559 B1 2/2001 Munsell
6,282,817 B1 9/2001 Curet
6,334,240 B1 1/2002 Li
6,339,867 B1 1/2002 Azam
6,438,871 B1 8/2002 Culverwell
6,588,079 B1 7/2003 Manzano
6,622,358 B1 9/2003 Christy
6,729,000 B1 5/2004 Liu
6,735,829 B2 5/2004 Hsu
6,938,308 B2 9/2005 Funk
7,082,701 B2 8/2006 Dalgaard
7,100,901 B2 9/2006 Gleinser
7,152,285 B2 12/2006 Liao
7,313,849 B2 1/2008 Liu
7,320,161 B2 1/2008 Taylor
7,360,282 B2 4/2008 Borsoi
7,591,050 B2 9/2009 Hammerslag
7,681,289 B2 3/2010 Liu
8,046,937 B2 11/2011 Beers
8,141,273 B2 3/2012 Stramare
8,230,560 B2 7/2012 Luzlbauer
8,231,074 B2 7/2012 Hu
8,332,994 B2 12/2012 Lin
8,371,004 B2 2/2013 Huber
8,381,362 B2 2/2013 Hammerslag
9,185,948 B2 11/2015 Ben-Arie
2002/0002781 A1 1/2002 Bouirer
2003/0226284 A1 12/2003 Grande
2005/0005477 A1 1/2005 Borsoi
2006/0213085 A1 9/2006 Azam
2007/0169380 A1 7/2007 Borsoi
2008/0250618 A1 10/2008 Stramare
2009/0172929 A1 7/2009 Hwang
2010/0115744 A1 5/2010 Fong
2011/0094072 A1 4/2011 Lin
2013/0008056 A1* 1/2013 Vincent ..... A43B 5/04 36/117.1
2013/0239375 A1* 9/2013 Horimoto ..... A44B 11/065 24/69 ST
2014/0224190 A1* 8/2014 Waters ..... A01K 27/005 119/863
2015/0113770 A1 4/2015 Laatz
2016/0166013 A1* 6/2016 Szewczyk ..... A44B 11/125 297/468
2016/0338451 A1* 11/2016 Scoffier ..... A41F 9/002
2017/0065034 A1* 3/2017 Tsai ..... A44B 11/12
2017/0258160 A1* 9/2017 Rowland ..... A44B 11/24

* cited by examiner

HIDDEN BLADE BELT RATCHETING DEVICE IV

CROSS-REFERENCE TO RELATED APPLICATIONS

This Application is Continuation In Part of application Ser. No. 16/792,324 Filed on Feb. 17, 2020

FEDERALLY SPONSORED RESEARCH

Not Applicable

SEQUENCE LISTING OR PROGRAM

Not Applicable

FIELD OF THE INVENTION

The invention is related to ratcheting devices for fastening belts, bands, straps, ribbons, cloth belts, suspenders, sandals, brassieres, watch bands, garment belts strips, laces chords, ropes, strings and alike.

BACKGROUND OF THE INVENTION

Prior Art

Several inventions were concerned with ratchet mechanisms configured for fastening waist belts. In U.S. Pat. No. 5,588,186A Soon-Myung Ko filed in 1995 May 26 a patent which teaches a belt with improved ratchet type buckling means. The ratcheting mechanism was constructed by a toothed belt and a releasable pawl in the buckle. In Application US20150113770A1 filed on 2014 Mar. 18 Robin LaatzKore taught a ratchet belt system which comprised a belt with a notch strip which extends along a portion of the length of the belt. The notch strip is formed of a plurality of adjacent notches, each being configured to engage a ratcheting pawl in the buckle. In principle, the notch strip is very similar to the toothed belt. Another invention which teaches a similar structured ratchet mechanism is presented by Jong Lee in application filed on 2004 May 7. The structure of toothed belt and similarly a notch strip belt is quite expensive to manufacture and is susceptible to accelerated wear since the imprinted belt is made of soft material. Furthermore, the ratchet pawl applies a strong shear force which equals to the total fastening force just on one tooth of the toothed belt. This shear force plays a major role in the belt's accelerated wear. In addition, the toothed structure is configured to provide fastening stations only at discrete spaces along the belt. In contrast, our invention does not suffer from these drawbacks.

Another prevalent approach for belt ratcheting is based on a ratchet wheel which rotates while mechanically linked to a cylinder with rough surface which compresses and fastens the belt. Such are the invention of Smetz-Rud Ketten et al. in patent application DE3344489A1 filed on 1983 Dec. 6. Also in U.S. Pat. No. 5,647,824A filed on 1995 Oct. 25, Levenson teaches a Weight lifter's belt incorporating strap fastened by a ratchet wheel. In U.S. Pat. No. 7,100,901B2 filed on 2001 Jun. 28 Gerhard Gleinser taught a Tension ratchet with a belt magazine also utilizing a ratchet wheel mechanism. Ratchet wheel mechanism is utilized in many other belt fastening inventions. In another approach, described in application Ser. No. 16/297,655 filed on 3 Sep. 2019 Jezekiel Ben-Arie taught a belt ratcheting device which employs an adaptive blocking mechanism which restricts belt motion backwards by a turning gate which applies an increasing pressure force on the belt, which is proportional to the backwards pulling force, when the turning gate is turned backwards by the belt motion backwards. The adaptive blocking mechanism facilitates belt motion forwards by the turning gate which diminishes the pressure force on the belt when the turning gate is turned forwards by the belt motion forwards. However, as detailed in the following sections, the adaptive blocking mechanism of Ben-Arie's ratcheting device has different structure compared to the belt ratcheting device described in the current application.

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in open position with the other hand and then switching the buckle into locked position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

U.S. PATENT APPLICATIONS

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Stramare describes a Shoe with Directional Conditioning Device for lace or the like. In US 2007/0169380 to Borsoi teaches a Device for B Flexible Strands. In US 2006/0213085 to Azam teaches an Article for Footware with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

On Feb. 17, 2020 Ben-Arie filed application Ser. No. 16/792,324 entitled "Belt Ratcheting Device III" (BRD-III), which was configured to achieve similar objectives to the objectives listed in next Section below. However, the BRD-III employed a blade which engaged the upper surface of the belt and caused scratch marks on the upper surface of the belt. Thus the main goal of the "Hidden Blade Belt Ratcheting Device IV" (HB-BRD) described below is to avoid such scratch marks.

BRIEF SUMMARY OF THE INVENTION

The objective of the invention of the: "Hidden Blade Belt Ratcheting Device IV" (HB-BRD) is to achieve the following goals:

1. A major goal of the invention is to configure a Hidden Blade Belt Ratcheting Device (HB-BRD) that facilitates a linear and continuous ratcheting of belts. It is required to configure ratcheting mechanism that enables to fasten a large variety of belts which engages only the lower surface of the belts in order to avoid visible scratch marks on the belts' upper surfaces. It is also desired that the configuration of the ratcheting mechanism will be based on a novel structure which yields a linear, continuous and smooth ratcheting. The HB-BRD is a continuous ratcheting method which is entirely different from traditional discrete ratcheting methods which employ a pawl and require a pattern belt imprinting such as: notch strips or toothed surfaces. Our novel ratcheting mechanism employs a turning gate with a hidden blade front which is installed diagonally in a channel and allows only unidirectional belt translation. This HB-BRD does not need belt imprinting and enables fastening of a large variety of smooth surface belts made not just of leather but also of cloth, plastics or other elastic materials.
2. A second target of the invention is to develop a HB-BRD that allows to achieve an accurate level of fastening i.e. the user has just to pull the belt exactly to the desired level of fastening and the belt does not slip backwards and remains fastened at the desired fastening level after the pulling ceases. This entails that the HB-BRD is to be configured to have a slip less, continuous ratcheting mechanism, which strongly restricts belt motion backwards but facilitates forwards motion of the belt. In addition, the HB-BRD has a turning gate which applies on the belt a blocking force which is proportional to the backwards force applied on the belt.

3. A third objective of the invention is to design a HB-BRD with a linear ratcheting mechanism which is mechanically more reliable because it depends on a simple structure which employs a minimal number of moving parts and therefore minimizes malfunction probability.
4. A fourth goal of the invention is to design a HB-BRD with a linear ratcheting mechanism which causes minimal belt wear on the lower surfaces of the belts and does not engage the upper surface of the belts. The hidden blade of the HB-BRD has a smooth side and the gipping wall also has smooth surface which facilitate belt sliding with minimal wear.
5. A fifth target of the invention is to design a HB-BRD with a releasing mechanism which is quick and easy to operate manually. The HB-BRD is configured to be switched from active fastening state to inactive state simply by pulling a latch which releases a leaf spring which opens the turning gate and releases the belt.
6. A sixth objective of the invention is to design a HB-BRD with a ratcheting mechanism structure, which is suited for low cost manufacturing and assembly because it has a simple structure which employs minimal number of moving parts. Furthermore, in order to facilitate low cost manufacturing, the HB-BRD is designed to be manufactured from plastic materials in its entirety except for a metallic blade. In order to achieve low cost production, the HB-BRD design avoids usage of metallic springs and configures all the required springs from resilient plastic materials. For economic manufacturing and assembly the HB-BRD mechanism also employs plastic axles and bearings.
7. A seventh objective of the invention is to configure a HB-BRD with low profile which is suitable also for fastening belts of footwear, garments, brassieres, watches or any other objects which use belts.

This specification describes an embodiment of the invention that is a belt ratcheting configuration which has a belt ratcheting mechanism which is designed for ratcheting a large variety of belts which have different thicknesses and widths and are made of different materials. This embodiment also facilitates easy fastening of belts, laces, ropes, strings and alike. The basic Hidden Blade Belt Ratcheting Device (HB-BRD) can be configured to have a small size and thus it can be used to fasten belts, bands, straps, ribbons, waist belts, suspenders, sandals, brassieres, watch bands, garment belts, and any sort of belts or bands connected to or used for wrapping of objects which need fastening. The HB-BRD can be used to fasten a belt simply by inserting the belt into the HB-BRD and pulling it. The HB-BRD has a linear ratcheting mechanism with two states: "active" and "inactive". In the inactive state the ratcheting mechanism is disabled and the belt is free to move forwards and backwards. In the active state the device works as a linear belt ratchet i.e. allowing the belt to be pulled forwards but severely restricts or even completely blocks any belt motion backwards. After the user has fastened the belt it remains fastened until the mechanism is switched into the inactive state. The HB-BRD ratcheting mechanism can be regarded also as an adaptive blocking mechanism which generates on the belt a blocking pressure which is proportional to the backwards pulling force applied to the belt. This adaptive blocking mechanism is adaptive and restricts backwards belt motion very efficiently because it generates a pressure force which results in a friction based belt blocking force which is proportional to the belt's backwards pulling force. So, the hardest the belt is pulled backwards the strongest is the blocking force generated by the ratcheting mechanism which prevents it from moving backwards.

The HB-BRD has a channel for fastening one belt. In the embodiment described here, the channel comprises a gripping wall. The channel includes two major openings: an entrance for the belt and an exit for the belt. The forwards direction in the channel is defined as the direction from the entrance to the exit. The backwards direction is opposite to the forwards direction. A turning gate is rotatably installed in the channel on an axle, which is supported by two bearings installed in the channels' side walls. The axle is centered at the turning gate's fulcrum located at the turning gate's axis of rotation. The turning gate comprises of a blade holder at the turning gate's front end and an attached elastic part at the turning gate's rear end. The axis of rotation is situated between the front end and the rear end. The blade holder holds a blade which includes a tapered blade front. The blade is inserted into the blade holder such that the sharp blade front protrudes in front of the blade holder. The blade is tapered gradually narrowing towards the blade front and ending with a sharp blade front, which protrudes in front of the blade holder. The sharp blade front is adapted with a smooth side. The sharp blade front is configured to concentrate the pressure force on the belt when the turning gate is turned backwards while the sharp blade front engages the belt. The smooth side is configured to engage the belt when the turning gate is turned forwards. The smooth side is configured to facilitate sliding of the belt while the turning gate is turned forwards and the belt is translated in the forwards direction.

The surface of the gripping wall is adapted with a smooth surface. The smooth surface is configured to facilitate sliding of the belt when the belt is fastened forwards during the active state and also when the belt is translated forwards or backwards during the inactive state.

As an option, the HB-BRD may comprise one or more bulges, which are disposed on the surface of the gripping wall. Each bulge is configured to cause an additional bending of the belt due to the pressure force applied on it by the blade's front. The additional bending is configured to increase a mutual friction force between the belt and the surface of the gripping wall while the HB-BRD is in the active state and the belt is pulled in the backwards direction.

As another option, the gripping wall could comprise a recess (a depression) opposite the blade front end. The recess is configured to cause an additional bending of the belt due to the pressure force applied on it by the blade's front end. The additional bending is configured to increase the mutual friction force between the belt and the surface of the gripping wall while the HB-BRD is in the active state and the belt is pulled in the backwards direction.

The turning gate is installed in the channel in a forward leaning diagonal orientation such that a straight line emanating from the blade front and passing through the axis of rotation (i.e. fulcrum) is at an obtuse angle (i.e. angle greater than 90 degrees) with respect to the forwards direction. It means that the obtuse angle which is centered at the blade front and is measured between the two lines emanating from the angle's center (the blade front). One line starts at the angle's center and passes through the axis of rotation and the second line starts at the angle's center and is parallel to the forwards direction of the channel. The blade front is disposed within the channel opposite the gripping wall and there exist a gap between the blade front and the gripping wall. The belt that is transported in the channel is configured to pass through the gap between the blade front and the gripping wall. In the HB-BRD structure the gripping wall is situated on top of the blade. This results in the blade engaging the lower surface of the belt which translates via the gap between the gripping wall and the blade. So the blade is hidden below the belt.

Due to the diagonal position of the turning gate in the channel, when the turning gate is turned increasingly backwards, the turning gate is configured to reduce the gap and consequently to increase the pressure force exerted by the blade front on the belt. The gate is considered as turning backwards when the front end travels backwards while turning. The gate is considered as turning forwards when the front end travels forwards while turning. Due to the diagonal construction of the turning gate in the channel, when the turning gate is turned increasingly forwards, the turning gate is configured to increase the gap and consequently to reduce the pressure force exerted by the blade front on the belt.

When the HB-BRD is at the active state, the blade front is configured to exert a pressure force on the belt. Since the blade front is configured to frictionally engage the belt it is also configured to turn forwards the turning gate when the belt is translated in forwards direction and drags forwards the front end due to their mutual friction. Similarly, at the active state the blade front is configured to frictionally engage the belt and to turn backwards the turning gate when the belt is translated in backwards direction and drags backwards also the front end due to their mutual friction.

The turning gate is configured to facilitate forwards translation of the belt by turning increasingly forwards while increasing the gap and consequently diminishing the pressure force of the blade front on the belt. On the other hand, the turning gate is configured to restrict backwards translation of the belt by turning increasingly backwards while reducing the gap and consequently increasing the pressure force of the blade front on the belt. Hence, in the active state of the HB-BRD the turning gate is configured to allow only unidirectional translation of the belt in the forwards direction. On the other hand, while the ratcheting device is in the inactive state, the blade front is configured not to exert pressure force on the belt and translation of the belt is facilitated both in the forwards direction and in the backwards direction.

The elastic part which is at the turning gate's rear end, is structured as a resilient plate which acts as a flat spring which is attached to the blade holder which is situated at the turning gate's front end. While in the active state, the resilient plate is configured to be at a bent state (biased state) and is configured to apply backwards turning force on the turning gate. The backwards turning force is configured to turn the turning gate backwards, which is configured to reduce the gap and consequently to apply a pressure force on the belt. Thus, while at the active state the turning gate is configured to apply a pressure force on the belt.

While in the active state, the resilient plate is held in the bent state by a latch which is resiliently attached to a wall of the channel. When manually pulled, the latch is configured to release the resilient plate from its bent state. The resilient plate is configured to turn forwards and to diminish the backwards turning force on the turning gate when the resilient plate is released and to switch the ratcheting device from the active state into the inactive state.

In order to facilitate HB-BRD switching from the active state into the inactive state, the resilient plate is attached to a leaf spring at a leaf spring first end wherein the leaf spring second end is unattached and is situated below the resilient plate. When the resilient plate is rotated downwards (i.e. backwards) towards the active state, the first end of the leaf spring is configured to move downwards as well and the second end of the leaf spring which is configured to be pressed against an upper wall of the channel while bending the leaf spring. When the ratcheting device is at the active state and the latch is pulled, the resilient plate is configured to turn forwards the turning gate and the bent leaf spring is configured to be released and to facilitate turning forwards the resilient plate along with the turning gate towards the inactive state.

The elastic part i.e. the resilient plate attached at the rear side of the turning gate is being configured also to serve as a lever for manually switching the ratcheting device from the active state into the inactive state by manually turning up the resilient plate which also turns forwards the attached turning gate and consequently diminishes the pressure force exerted by the blade front on the belt. The elastic part is being configured also to serve as a lever for manually switching the ratcheting device from the inactive state into the active state by manually turning down the resilient plate which also turns backwards the attached turning gate and consequently increases the pressure force exerted by the blade front on the belt.

When the ratcheting mechanism is in active state, the gap has been narrowed such that the blade front (i.e. front end) applies a pressure force which is squeezing against the gripping wall the belt in the gap with its blade front i.e. the sharp blade front. At this situation, the turning gate acts as a belt ratchet. It means that the turning gate allows forwards fastening motion of the belt but blocks or severely restricts any belt translation in backwards direction. In order to have a belt ratchet operation, the turning gate is installed in a forwards leaning diagonal orientation in the channel such that its blade front is closer to the gripping wall than the gate's axis of rotation. Also, in a forwards leaning diagonal state, the turning gate's blade front (front end) is closer to the channel's exit than the turning gate's axis of rotation. The definition here of forwards leaning diagonal orientation of the turning gate is equivalent to the definition above in Section [0019] of the orientation of the turning gate which is based on a straight line emanating from the blade front and passing through the axis of rotation (i.e. fulcrum) which is at an obtuse angle (i.e. angle greater than 90 degrees) with respect to the forwards direction.

The ratchet operation of the gate stems from the forward leaning diagonal orientation of the turning gate, which allows forwards belt motion when the belt is pulled forwards. Pulling forwards the belt which is squeezed in the gap, drags forwards the turning gate's blade front due to the friction force which naturally exists between the belt and the blade front as a natural consequence of the pressure force applied by the blade front on the belt. Thus, when the front end is dragged forwards also the turning gate turns forwards. Due to the forwards leaning diagonal orientation of the turning gate, when its blade front is turned forwards it is moved forwards and it also has a motion component that moves it laterally inwards i.e. away from the gripping wall, whereby increasing the width of the gap between the blade front and its gripping wall which in turn results in diminished pressure force of the blade front on the belt. Reduced pressure force on the belt results in reduced friction between the belt and the surface of the gripping wall and also reduced friction between the belt and the blade's front. This facilitates even easier forwards motion of the belt.

On the other hand, if the belt is pulled backwards it also drags the turning gate's blade front backwards (i.e. turning the gate backwards) since the blade front applies a squeezing force on the belt, which results in a mutual friction force with the belt. Hence, when the blade front moves backwards also the turning gate turns backwards as well. Due to the forwards leaning diagonal orientation of the gate, the motion backwards of the blade front has also a lateral outwards motion component which moves the blade front (at the front end) towards the gripping wall thus further narrowing the gap and further restricting backwards belt motion. Hence, in an active state the gate acts as a belt ratchet i.e. allows belt forwards motion but severely restricts belt's backwards motion. When the ratcheting mechanism is switched into inactive state by turning the turning gate forwards, the gap is widened more than the belt's width and the belt is entirely released because it can move freely forwards or backwards in the channel without engaging the blade. The user can easily switch the ratcheting mechanism from active to inactive state simply by manually turning up the resilient plate which also turns forwards the attached turning gate. When the gate turns forwards and increases the gap's width it also inactivates the ratchet mechanism of the HB-BRD. On the other hand, when the resilient plate is turned down, it also turns the attached turning gate backwards into the active state. The HB-BRD can be manufactured at low cost because it has a simple structure with only few parts, which could be made from plastic materials at its entirety except the metallic blade.

The HB-BRD's structure is different from other belt fastening devices in few important aspects. Primarily, the HB-BRD enables a belt ratcheting operation which causes only minimal wear of the belt since it employs in the channel a novel structure with a diagonally forwards leaning turning gate with a single tapered blade front at its front end, i.e. single sharp blade front which is configured to have a smooth side (for certain applications, such as in controlling wide belts, the front end can be split into several blades if more efficient). When the belt is moved forwards, the tapered blade end i.e. sharp blade front at the front end of the turning gate rotates forwards this also turns the smooth side of the tapered end to be approximately parallel with the belt and the belt is sliding on the smooth side of the tapered end i.e. causing minimal wear of the belt. To further reduce belt's wear, the gripping wall opposite to the blade front (i.e. front end) was adapted to have a smooth surface as well. Also, when the HB-BRD is in inactive state, the gate is in forwards rotation, which also widens the gap more than the belt's width this eliminates belt friction and wear while the belt is moved forwards or backwards. Since the belt is blocked from moving backwards in the active state, there is no belt wear in the backwards motion as well. In addition, the HB-BRD's gripping wall is manufactured with a smooth surface to minimize belt wear when it moves in the gap as well. In contrast, other belt fastening devices employ serrated surfaces with sharp teeth structures which engage the belt and are designed to block belt movement while in blocked state. However, sharp teeth surfaces cause significant belt wear even when they are in their unblocked state since their teeth remain pointed at the belt and the belt still touches them as it moves even in a wider gap. In our HB-BRD the sharp front end could be split into two or more separate blades which engage the belt simultaneously.

The HB-BRD has many advantages over previous devices primarily due to its efficient and easy fastening operation by a ratchet mechanism which requires the user just to pull the belt to the desired fastening level. Once the belt is pulled, it remains fastened until the ratcheting mechanism is switched from active state into inactive state whereby it disables the ratchet mechanism and releases the belt. Additional advantage over all the other belt ratchets is that its ratchet mechanism does not use belt imprinted toothed strips. Fastening belts with ratchet devices which have belt imprinted surfaces, which regularly have sharp teeth, as all other ratchet belt fasteners do, results in increased wear of the imprinted strips on the belts. As a consequence, the ratchet mechanisms of such devices malfunctions after short use. In contrast, the diagonal orientation of the tapered i.e. sharp edges at the sharp blade fronts of the turning gates in the HB-BRDs, cause very little belt wear because each sharp blade front has a smooth side on which the belt can slide when it is fastened. The HB-BRD was worn and tested daily by the Applicant for more than a year on various belts without any noticeable belt wear.

DETAILED DESCRIPTION OF THE DRAWINGS

Figure 1:
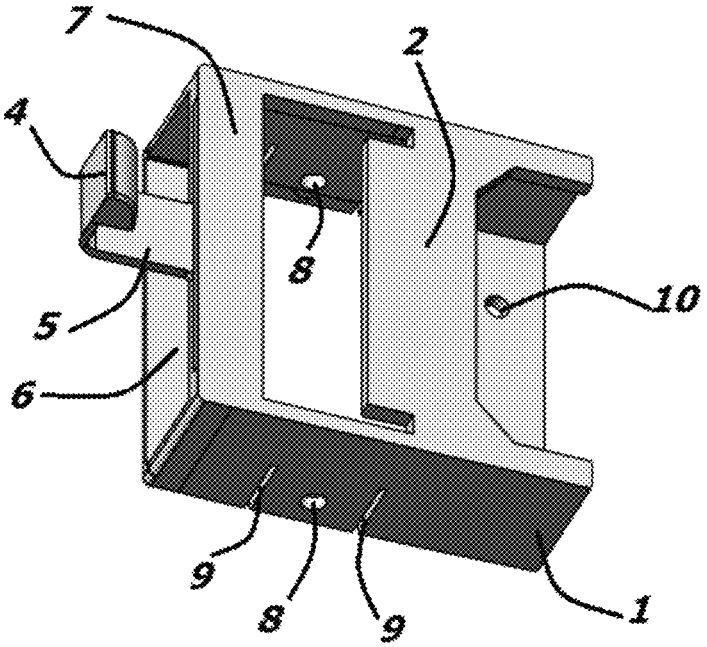
FIGS. 1 and 2 illustrate two views of 3D isometric drawings of an embodiment of a channel structure of the Hidden Blade Belt Ratcheting Device (HB-BRD).
Figure 2:
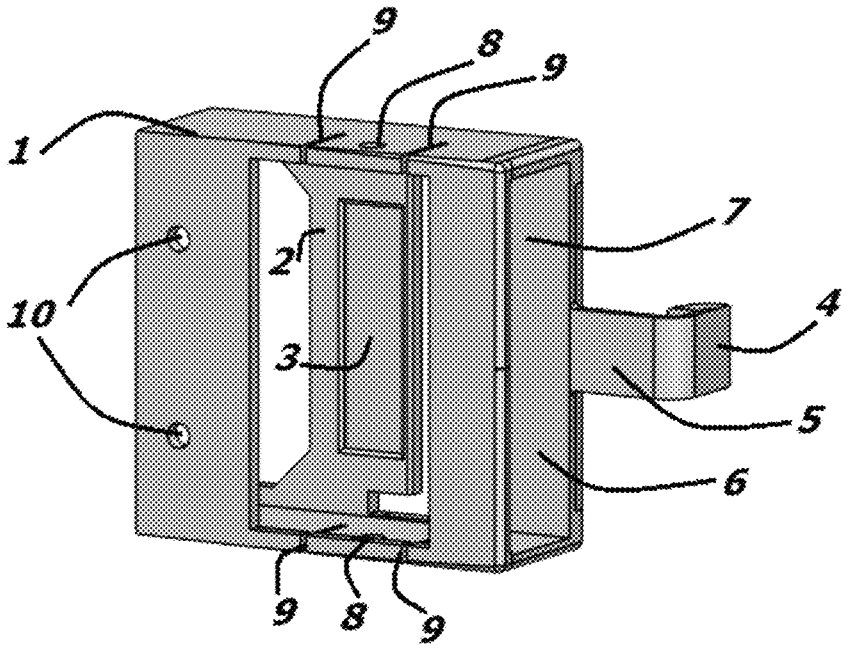

FIGS. 1 and 2 illustrate two views of 3D isometric drawings of a channel structure embodiment of a Hidden Blade Belt Ratcheting Device 1 (HB-BRD). The channel's 6 entrance is illustrated in FIG. 1 on the left hand side and the channel's 6 exit on the right hand side. The top side of the gripping wall 2 is shown in FIG. 1 whereas FIG. 2 shows the bottom side of the gripping wall 2. The depression 3 (recess) in the gripping wall 2 is configured to bend the belt when it is pressed by the front side 23 of the blade 15 of the turning gate 11. The HB-BRD's channel 6 includes the gripping wall 2 at the channel's top side. The gripping wall 2 also has a recess 3 configured to bend the belt and thus to increase the friction and the restricting force of blocked belts. Latch 4 is resiliently connected to the channel's latch support wall 7 by the elastic connection 5 for the latch 4. The two holes 10 in the channel's floor are configured to house rivets 22 (illustrated in FIGS. 6 and 8) which attach the second belt's end 21 to the channel structure 1.

Figure 3:
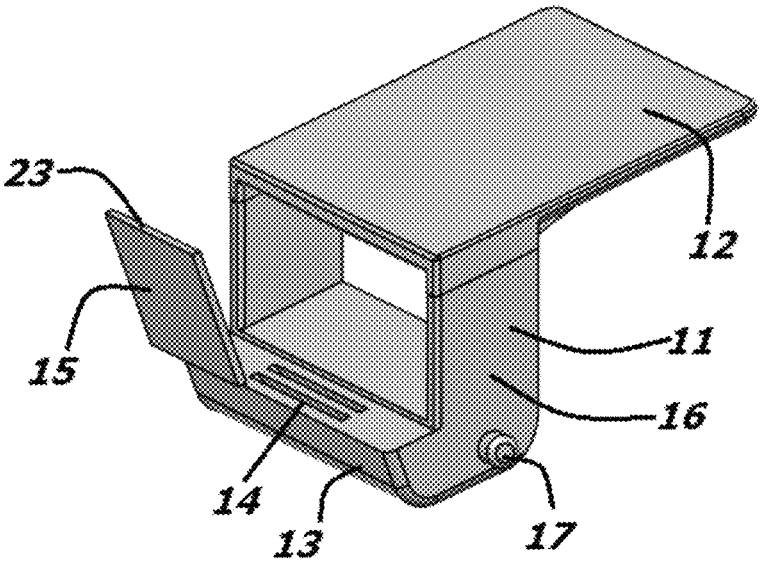
FIGS. 3 and 4 illustrate two views of 3D isometric drawings of an embodiment of a turning gate structure of the Hidden Blade Belt Ratcheting Device (HB-BRD).
Figure 4:
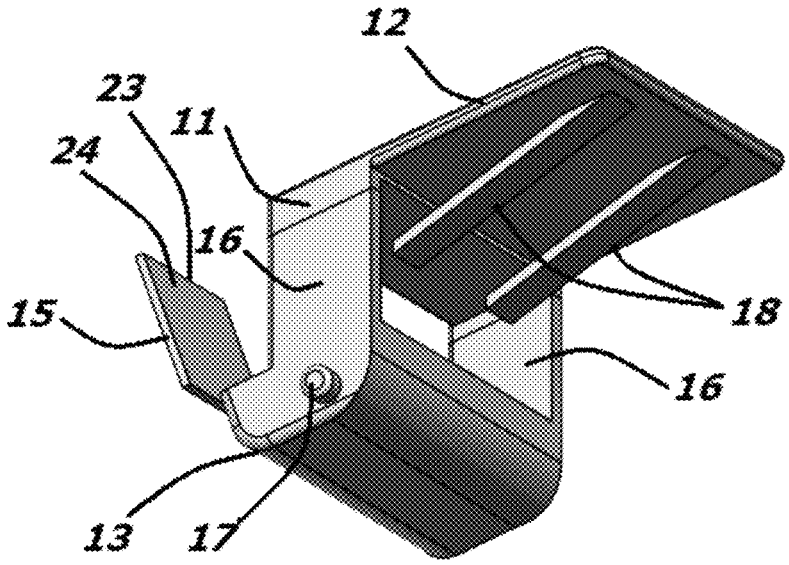

FIGS. 3 and 4 illustrate two views of 3D isometric drawings of an embodiment of a turning gate 11 structure of the Hidden Blade Belt Ratcheting Device (HB-BRD). The turning gate 11 has two axles 17 which are installed in bearings 8 situated at the channel's side walls. Each of the bearings 8 is installed between two slots 9 in the channels side walls. These slots 9 allow the side walls to bend during axles 17 installation. The turning gate 11 has a lever 16 which is connected to the blade holder 13 at its front side and to the resilient plate 12 at its rear side. The resilient plate 12 is configured to act as a biased spring which tends to keep the turning gate in the active state in which the turning gate is turned backwards while the blade front 23 presses the belt in the channel 6. The blade holder 13 has blade slots 14 which are configured to hold the blade 15. The blade 15 has a tapered front end 23 and a smooth side 24. The tapered front end 23 is sharp and is configured to concentrate pressure force on the belt at the HB-BRD active state. The smooth side 24 is configured to facilitate belt sliding forwards and backwards in the channel 6. The resilient plate 12 is equipped with two leaf springs 18 which are diagonally attached at one of their ends to the lower face of the resilient plate 12 and the other ends of the leaf springs 18 are free i.e. not attached. When the HB-BRD is in active state, the resilient plate is turned downwards causing the free ends of the leaf springs to be bent and pressed against the upper face of the channel's latch support wall 7. When the latch 4 releases the resilient plate 12, the leaf springs 18 push the resilient plate 12 upwards turning forwards the turning gate 11 into the inactive state in which the blade's front end 23 does not engage the belt and the belt is free to translate both forwards and backwards.

As already mentioned, the hidden blade belt ratcheting device HB-BRD has an active state and an inactive state. While in the active state the HB-BRD 1 is configured to restrict translation of the belt in the channel 6 in a backwards direction and to facilitate translation of the belt in the channel in a forwards direction. While in the inactive state, the belt ratcheting device is configured to facilitate translation of the belt both in forwards direction (i.e. from left to right in FIG. 1) and in backwards direction.

The turning gate 11 is installed in the channel 6 such that a straight line emanating from the blade front 23 and passing through the axle 17 is at an obtuse angle with respect to the forwards direction which is a vector pointing from the entrance of channel 6 and ending at the exit of channel 6. The blade front 23 is disposed within the channel 6 opposite the gripping wall 2. Wherein the blade front 23 is disposed opposite the gripping wall 2 such that there is a gap between the blade front 23 and the gripping wall 2. The belt is configured to pass through the gap between the blade front and the gripping wall.

The turning gate 11 is configured to reduce the gap and to increase the pressure force exerted by the blade front 23 on the belt when the turning gate 11 is turned increasingly backwards. The turning gate 11 is configured to increase the gap and to reduce the pressure force exerted by the blade front 23 on the belt when the turning gate 11 is turned increasingly forwards. At the active state, the blade front 23 is configured to exert a pressure force on the belt and the blade front 23 is configured to frictionally engage the belt and to turn forwards the turning gate 11 when the belt is translated in the forwards direction. Also, at the active state the blade front 23 is configured to frictionally engage the belt and to turn backwards the turning gate 11 when the belt is translated in the backwards direction. The turning gate 11 is configured to facilitate forwards translation of the belt by turning increasingly forwards and consequently diminishing the pressure force of the blade front 23 on the belt. The turning gate 11 is configured to restrict backwards translation of the belt by turning increasingly backwards and consequently increasing the pressure force of the blade front 23 on the belt. At the inactive state of the ratcheting device, the blade front 23 is configured not to exert said pressure force on the belt and translation of the belt is facilitated both in the forwards direction and in the backwards direction. The turning gate's fulcrum is at axles 17 which are fitted into a pair bearings 8.

The blade 15 is tapered towards the blade front 23. The blade front 23 ends with a sharp blade front 23. Wherein the sharp blade front 23 is adapted with a smooth side 24. The sharp blade front 23 is configured to concentrate the pressure force on the belt when the turning gate 11 is turned backwards while the sharp blade front 23 engages the belt. The smooth side 24 is configured to engage the belt when the turning gate 15 is turned forwards. The smooth side 24 is configured to facilitate belt sliding while the turning gate 11 is turned forwards and the belt is translated in the forwards direction.

The Belt Ratcheting Device further comprising a depression (recess) 3 disposed on the surface of the gripping wall 2 where the depression 3 is configured to cause an additional bending of the belt due to the pressure force. The additional bending is configured to increase a mutual friction force between the belt and the surface of the gripping wall while the ratcheting device 1 is in said active state and the belt is pulled in the backwards direction.

The surface of the gripping wall 2 is facing downwards and the blade front 23 engages a lower surface of the belt by moving upwards. The belt further comprises a first belt end 20 and a second belt end 21. The Belt ratcheting device 1 is configured for belt fastening by tying said second belt end 21 to the Belt ratcheting device 1 and fastening said first belt end 20 to the Belt ratcheting device 1. When the belt is fastened the first belt end 20 is configured to pull the Belt ratcheting device 1 in backwards direction, while the second belt end 21 is configured to pull in said forwards direction the belt ratcheting device.

The resilient plate 12 is attached to a pair of leaf springs 18 at the leaf springs first ends. Where a leaf springs second ends are unattached and are situated below the resilient plate 12.

When the resilient plate 12 is rotated downwards towards the active state, the first ends of the leaf springs are configured to move downwards as well and the second ends of the leaf springs are configured to move downwards as well and to be pressed against the top side of the support wall 7 of the elastic connection 5 of the latch 4, while bending the leaf springs 18. When the Belt ratcheting device 1 is at the active state and the latch 4 is pulled, the resilient plate 12 is configured to turn forwards the turning gate 11 and the bent leaf springs 18 are configured to be released and to facilitate turning forwards the resilient plate 12 and the turning gate 11 towards the inactive state.

The resilient plate 12 is being configured also to serve as a lever for manually switching the ratcheting device from the active state into the inactive state by manually turning up the resilient plate 12 which also turns forwards the turning gate 11 which is configured to increase the gap and to diminish the pressure force exerted by the blade front 23 on the belt. Wherein the resilient plate 12 is being configured also to serve as a lever for manually switching the ratcheting device from the inactive state into the active state by manually turning down the resilient plate which is configured to turn backwards the turning gate 11 which is configured to reduce the gap and to increase the pressure force exerted by the blade front 23 on the belt.

Figure 5:
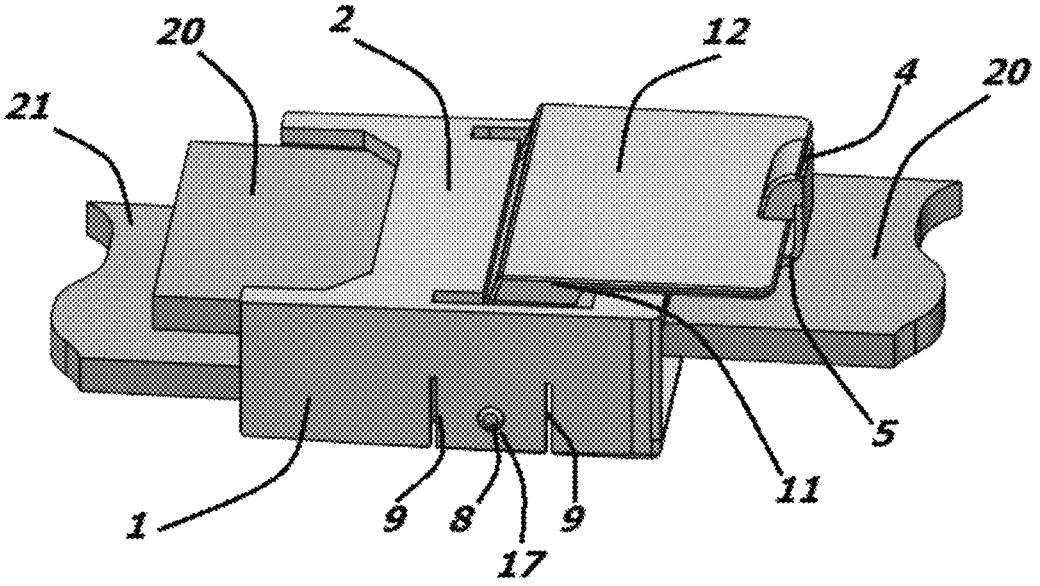
FIG. 5 illustrates in 3D isometric drawing an assembled HB-BRD in an active state while inserted with a portion of the belt ends.
Figure 6:
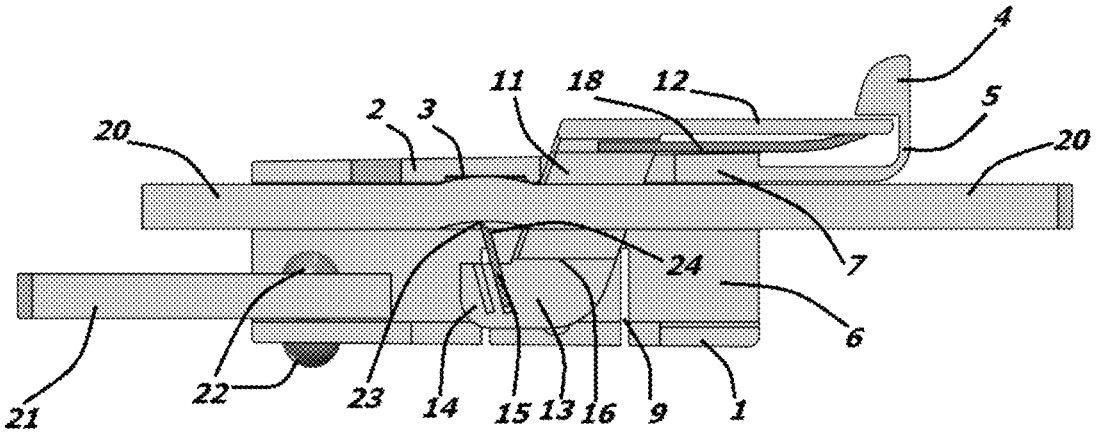
FIG. 6 illustrates a cross section of FIG. 5 which displays an assembled HB-BRD in an active state while inserted with a portion of the belt ends.

FIG. 5 illustrates in 3D isometric drawing an assembled HB-BRD in an active state while inserted with a portions of the belt ends 20 and 21. FIG. 6 illustrates a cross section of FIG. 5 which displays an assembled HB-BRD in an active state while inserted with portions of the belt ends 20 and 21.

The resilient plate 12 in FIGS. 5 and 6 is turned backwards and is firmly held down by Latch 4. In the cross section displayed in FIG. 6 the resilient leafs 18 are bent and pressed against the top side of the support wall 7 for the resilient latch section 5. The belt bending into the gripping wall's 2 recess 3 due to pressure force applied by the blade's front 23 is quite noticeable. The first belt end 20 is being ratcheted by the blade 15 whereas the second blade end 21 is riveted and attached to the channel's structure 1 by two rivets 22.

Figure 7:
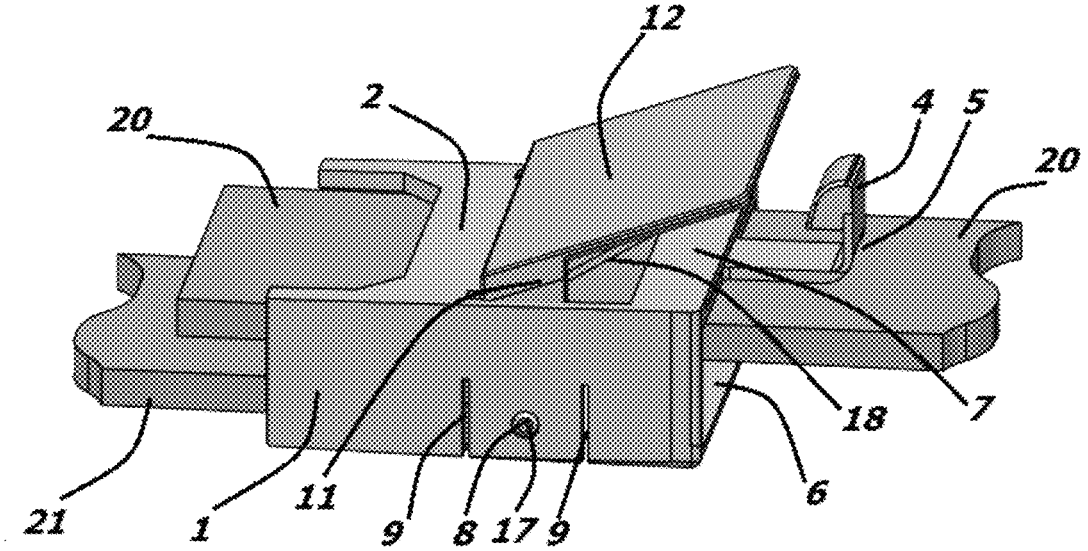
FIG. 7 illustrates in 3D isometric drawing an assembled HB-BRD in inactive state while inserted with a portion of the belt ends.
Figure 8:
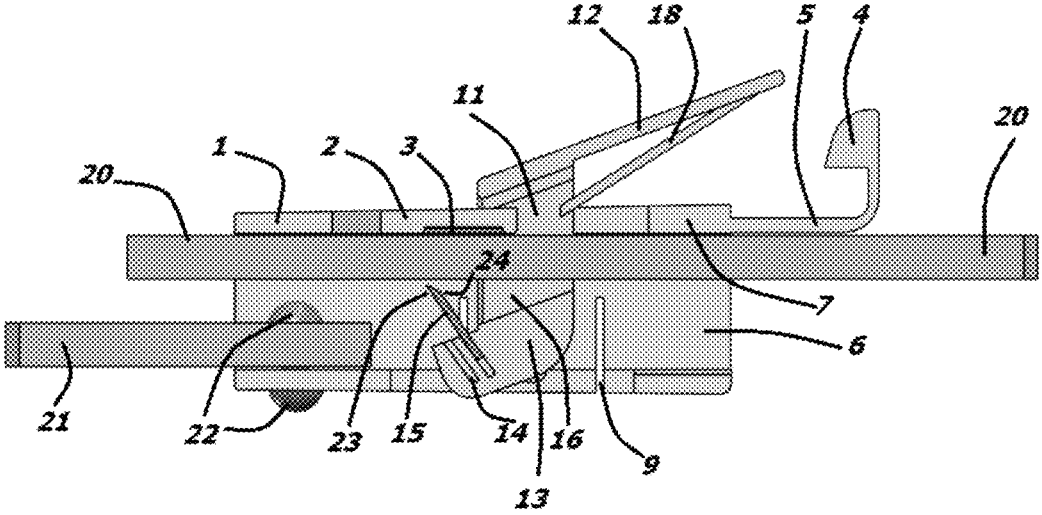
FIG. 8 illustrates a cross section of FIG. 7 which displays an assembled HB-BRD in an inactive state while inserted with a portion of the belt ends.

FIG. 7 illustrates in 3D isometric drawing an assembled HB-BRD in an inactive state while inserted with portions of the belt ends 20 and 21. FIG. 8 illustrates a cross section of FIG. 7 which displays an assembled HB-BRD in an inactive state while inserted with portions of the belt ends 20 and 21. The resilient plate 12 in FIGS. 7 and 8 is turned forwards and is released from Latch 4. In the cross section displayed in FIG. 8 the resilient leafs 18 are unbent and not pressed against the top side of the support wall 7 for the elastic connection 5 of the latch 4. The belt is not bended into the gripping wall's 2 recess 3 since there is no pressure force applied by the blade's front 23 on the belt. The first belt end 20 is free of being ratcheted by the blade 15 whereas the second blade end 21 is riveted and attached to the channel's structure 1 by two rivets 22.

What is claimed is:

1. A ratcheting device configured for fastening a belt and releasing a fastened belt;

wherein the ratcheting device comprising: a channel, a turning gate, a blade and said belt;

wherein the channel is being configured to carry through a portion of the belt;

said channel further comprises a gripping wall being adapted with a surface configured to engage said belt;

the ratcheting device has an active state and an inactive state;

the ratcheting device while in the active state is configured to restrict translation of the belt in the channel in a backwards direction and to facilitate translation of the belt in the channel in a forwards direction;

the ratcheting device while in the inactive state is configured to facilitate translation of the belt both in said forwards direction and in said backwards direction;

the turning gate being rotationally engaged with the channel at a fulcrum, wherein the turning gate comprises a blade holder attached to an elastic part;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forwards direction; wherein the blade front is disposed within the channel opposite the gripping wall; wherein the blade front is disposed opposite the gripping wall such that there is a gap between the blade front and the gripping wall; wherein the belt is configured to pass through the gap between the blade front and the gripping wall;

wherein, the turning gate is configured to reduce the gap and to increase a pressure force exerted by the blade front on the belt when the turning gate is turned increasingly backwards; wherein the turning gate is configured to increase the gap and to reduce the pressure force exerted by the blade front on the belt when the turning gate is turned increasingly forwards;

at the active state, the blade front is configured to exert the pressure force on the belt and the blade front is configured to frictionally engage the belt and to turn forwards the turning gate when the belt is translated in said forwards direction;

in addition, at the active state the blade front is configured to frictionally engage the belt and to turn backwards the turning gate when the belt is translated in said backwards direction;

wherein the turning gate is configured to facilitate forwards translation of the belt by turning increasingly forwards and diminishing the pressure force of the blade front on the belt;

wherein the turning gate is configured to restrict backwards translation of the belt by turning increasingly backwards and increasing the pressure force of the blade front on the belt;

at the inactive state of the ratcheting device, the blade front is configured not to exert said pressure force on the belt and translation of the belt is facilitated both in the forwards direction and in the backwards direction;

wherein said fulcrum comprises an axle which is fitted into a bearing;

wherein the surface of the gripping wall is facing downwards and the blade front engages a lower surface of the belt by moving upwards.

2. A ratcheting device configured for fastening a belt and releasing a fastened belt;

wherein the ratcheting device comprising: a channel, a turning gate, a blade and said belt;

wherein the channel is being configured to carry through a portion of the belt;

said channel further comprises a gripping wall being adapted with a surface configured to engage said belt;

the ratcheting device has an active state and an inactive state;

the ratcheting device while in the active state is configured to restrict translation of the belt in the channel in a backwards direction and to facilitate translation of the belt in the channel in a forwards direction;

the ratcheting device while in the inactive state is configured to facilitate translation of the belt both in said forwards direction and in said backwards direction;

the turning gate being rotationally engaged with the channel at a fulcrum, wherein the turning gate comprises a blade holder attached to an elastic part;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forwards direction; wherein the blade front is disposed within the channel opposite the gripping wall; wherein the blade front is disposed opposite the gripping wall such that there is a gap between the blade front and the gripping wall; wherein the belt is configured to pass through the gap between the blade front and the gripping wall;

wherein, the turning gate is configured to reduce the gap and to increase a pressure force exerted by the blade front on the belt when the turning gate is turned increasingly backwards; wherein the turning gate is configured to increase the gap and to reduce the pressure force exerted by the blade front on the belt when the turning gate is turned increasingly forwards;

at the active state, the blade front is configured to exert the pressure force on the belt and the blade front is configured to frictionally engage the belt and to turn forwards the turning gate when the belt is translated in said forwards direction;

in addition, at the active state the blade front is configured to frictionally engage the belt and to turn backwards the turning gate when the belt is translated in said backwards direction;

wherein the turning gate is configured to facilitate forwards translation of the belt by turning increasingly forwards and diminishing the pressure force of the blade front on the belt;

wherein the turning gate is configured to restrict backwards translation of the belt by turning increasingly backwards and increasing the pressure force of the blade front on the belt;

at the inactive state of the ratcheting device, the blade front is configured not to exert said pressure force on the belt and translation of the belt is facilitated both in the forwards direction and in the backwards direction;

wherein said fulcrum comprises an axle which is fitted into a bearing;

wherein the surface of the gripping wall is facing downwards and the blade front engages a lower surface of the belt by moving upwards;

wherein said elastic part is structured as a resilient plate which acts as a flat spring which is attached to the blade holder; while in the active state, the resilient plate is configured to be at a bent state and is configured to apply said backwards turning force on the turning gate; wherein the backwards turning force is configured to turn the turning gate backwards, which is configured to reduce the gap and to apply the pressure force on the belt; wherein at the active state the turning gate is configured to apply a pressure force on the belt;

while in the active state, the resilient plate is held in the bent state by a latch which is resiliently attached to a support wall of the ratcheting device; wherein when manually pulled, the latch is configured to release the resilient plate from the bent state; wherein the turning gate is configured to diminish the backwards turning force when the resilient plate is released and to switch the ratcheting device from the active state into the inactive state.

3. A ratcheting device configured for fastening a belt and releasing a fastened belt;

wherein the ratcheting device comprising: a channel, a turning gate, a blade and said belt;

wherein the channel is being configured to carry through a portion of the belt;

said channel further comprises a gripping wall being adapted with a surface configured to engage said belt;

the ratcheting device has an active state and an inactive state;

the ratcheting device while in the active state is configured to restrict translation of the belt in the channel in a backwards direction and to facilitate translation of the belt in the channel in a forwards direction;

the ratcheting device while in the inactive state is configured to facilitate translation of the belt both in said forwards direction and in said backwards direction;

the turning gate being rotationally engaged with the channel at a fulcrum, wherein the turning gate comprises a blade holder attached to an elastic part;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forwards direction; wherein the blade front is disposed within the channel opposite the gripping wall; wherein the blade front is disposed opposite the gripping wall such that there is a gap between the blade front and the gripping wall; wherein the belt is configured to pass through the gap between the blade front and the gripping wall;

wherein, the turning gate is configured to reduce the gap and to increase a pressure force exerted by the blade front on the belt when the turning gate is turned increasingly backwards; wherein the turning gate is configured to increase the gap and to reduce the pressure force exerted by the blade front on the belt when the turning gate is turned increasingly forwards;

at the active state, the blade front is configured to exert the pressure force on the belt and the blade front is configured to frictionally engage the belt and to turn forwards the turning gate when the belt is translated in said forwards direction;

in addition, at the active state the blade front is configured to frictionally engage the belt and to turn backwards the turning gate when the belt is translated in said backwards direction;

wherein the turning gate is configured to facilitate forwards translation of the belt by turning increasingly forwards and diminishing the pressure force of the blade front on the belt;

wherein the turning gate is configured to restrict backwards translation of the belt by turning increasingly backwards and increasing the pressure force of the blade front on the belt;

at the inactive state of the ratcheting device, the blade front is configured not to exert said pressure force on the belt and translation of the belt is facilitated both in the forwards direction and in the backwards direction;

wherein said fulcrum comprises an axle which is fitted into a bearing;

wherein the surface of the gripping wall is facing downwards and the blade front engages a lower surface of the belt by moving upwards;

wherein said blade is tapered towards the blade front; wherein the blade front ends with a sharp blade front; wherein the sharp blade front is adapted with a smooth side;

wherein, the sharp blade front is configured to concentrate said pressure force on the belt when the turning gate is turned backwards while the sharp blade front engages the belt;

wherein, the smooth side is configured to engage the belt when the turning gate is turned forwards;

wherein, the smooth side is configured to facilitate said belt sliding while the turning gate is turned forwards and the belt is translated in the forwards direction.

4. The ratcheting device of claim 3, wherein the surface of the gripping wall is adapted with a smooth surface;

wherein, the smooth surface is configured to facilitate the belt sliding when the belt is fastened at the active state and also when the belt is translated in the inactive state.

5. The ratcheting device of claim 3, wherein the ratcheting device further comprising a depression disposed on the surface of the gripping wall; wherein said depression is configured to facilitate an additional bending of the belt due to said pressure force;

wherein, said additional bending is configured to increase a mutual friction force between the belt and the surface of the gripping wall while said ratcheting device is in said active state and the belt is pulled in said backwards direction.

6. A ratcheting device configured for fastening a belt and releasing a fastened belt;

wherein the ratcheting device comprising: a channel, a turning gate, a blade and said belt;

wherein the channel is being configured to carry through a portion of the belt;

said channel further comprises a gripping wall being adapted with a surface configured to engage said belt;

the ratcheting device has an active state and an inactive state;

the ratcheting device while in the active state is configured to restrict translation of the belt in the channel in a backwards direction and to facilitate translation of the belt in the channel in a forwards direction;

the ratcheting device while in the inactive state is configured to facilitate translation of the belt both in said forwards direction and in said backwards direction;

the turning gate being rotationally engaged with the channel at a fulcrum, wherein the turning gate comprises a blade holder attached to an elastic part;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forwards direction; wherein the blade front is disposed within the channel opposite the gripping wall; wherein the blade front is disposed opposite the gripping wall such that there is a gap between the blade front and the gripping wall; wherein the belt is configured to pass through the gap between the blade front and the gripping wall;

wherein, the turning gate is configured to reduce the gap and to increase a pressure force exerted by the blade front on the belt when the turning gate is turned increasingly backwards; wherein the turning gate is configured to increase the gap and to reduce the pressure force exerted by the blade front on the belt when the turning gate is turned increasingly forwards;

at the active state, the blade front is configured to exert the pressure force on the belt and the blade front is configured to frictionally engage the belt and to turn forwards the turning gate when the belt is translated in said forwards direction;

in addition, at the active state the blade front is configured to frictionally engage the belt and to turn backwards the turning gate when the belt is translated in said backwards direction;

wherein the turning gate is configured to facilitate forwards translation of the belt by turning increasingly forwards and diminishing the pressure force of the blade front on the belt;

wherein the turning gate is configured to restrict backwards translation of the belt by turning increasingly backwards and increasing the pressure force of the blade front on the belt;

at the inactive state of the ratcheting device, the blade front is configured not to exert said pressure force on the belt and translation of the belt is facilitated both in the forwards direction and in the backwards direction;

wherein said fulcrum comprises an axle which is fitted into a bearing;

wherein the surface of the gripping wall is facing downwards and the blade front engages a lower surface of the belt by moving upwards;

wherein said belt further comprises a first belt end and a second belt end; wherein said ratcheting device is configured for said belt fastening by tying said second belt end to said ratcheting device and fastening said first belt end with said ratcheting device;

wherein, when the belt is fastened, said first belt end is configured to pull said ratcheting device in said backwards direction, while second belt end is configured to pull in said forwards direction the belt ratcheting device.

7. The ratcheting device of claim 6, wherein at least one ratcheting device which is anchored to a footwear item, is configured to fasten said belt which is attached to the footwear item.

8. The ratcheting device of claim 2, wherein the resilient plate is attached to a leaf spring at a leaf spring first end; wherein a leaf spring second end is unattached and is situated below the resilient plate;

wherein when the resilient plate is rotated downwards towards the active state, the first end of the leaf spring is configured to move downwards as well and the second end of the leaf spring is configured to move downwards as well and to be pressed against the support wall of the ratcheting device while bending the leaf spring;

when the ratcheting device is at the active state and the latch is pulled, the resilient plate is configured to turn forwards the turning gate and the bent leaf spring is configured to be released and to facilitate turning forwards the resilient plate and the turning gate towards the inactive state.

9. The ratcheting device of claim 2, wherein the elastic part is being configured also to serve as a lever for manually switching the ratcheting device from the active state into the inactive state by manually turning up the resilient plate which also turns forwards the turning gate which is configured to increase the gap and to diminish the pressure force exerted by the blade front on the belt;

wherein the elastic part is being configured also to serve as a lever for manually switching the ratcheting device from the inactive state into the active state by manually turning down the resilient plate which is configured to turn backwards the turning gate which is configured to reduce the gap and to increase the pressure force exerted by the blade front on the belt.

10. The ratcheting device of claim 1, wherein the blade is made of metal.

11. The ratcheting device of claim 1, wherein the entire ratcheting device except the blade is made of plastics materials.

* * * * *